US006189583B1

(12) United States Patent
Kokko et al.

(10) Patent No.: US 6,189,583 B1
(45) Date of Patent: Feb. 20, 2001

(54) APPARATUS FOR REMOVING BARKS FROM A WOOD- AND BARK-CONTAINING LOG FLOW

(75) Inventors: Pekka Kokko, Hollola; Ari Hannimåki, Lahti; Jaakko Pitkåkangas, Hollola, all of (FI)

(73) Assignee: Andritz-Patentverwaltungs-GmbH, Graz (AT)

( * ) Notice: Under 35 U.S.C. 154(b), the term of this patent shall be extended for 0 days.

(21) Appl. No.: 09/319,602

(22) PCT Filed: Dec. 8, 1997

(86) PCT No.: PCT/FI97/00762

§ 371 Date: Jul. 28, 1998

§ 102(e) Date: Jul. 28, 1998

(87) PCT Pub. No.: WO98/25743

PCT Pub. Date: Jun. 18, 1998

(30) Foreign Application Priority Data

Dec. 10, 1996 (FI) ..... 964930

(51) Int. Cl.[7] ..... B27L 1/00

(52) U.S. Cl. ..... 144/208.4; 144/208.1; 144/341

(58) Field of Search ..... 144/208.1, 208.4, 144/208.6, 208.9, 340, 341, 208.3

(56) References Cited

U.S. PATENT DOCUMENTS

| | | | | |
|---|---|---|---|---|
| 1,319,935 | | 10/1919 | Thorne . | |
| 1,549,855 | | 8/1925 | Cote . | |
| 1,966,153 | * | 7/1934 | Thorne | 144/208.9 |
| 2,125,529 | | 8/1938 | Ullgren . | |
| 2,137,451 | | 11/1938 | Hillbom . | |
| 2,647,548 | | 8/1953 | Guettler . | |
| 2,684,089 | * | 7/1954 | Graham et al. | 144/208.4 |
| 2,894,697 | | 7/1959 | Panning et al. . | |
| 3,237,828 | * | 3/1966 | Bohler | 144/208.1 |
| 3,385,331 | | 5/1968 | Bronemo et al. . | |
| 3,624,756 | | 11/1971 | Mellgren . | |
| 3,656,697 | | 4/1972 | Nelson . | |
| 3,690,352 | | 9/1972 | Herolf . | |
| 3,866,639 | | 2/1975 | Kantola et al. . | |
| 4,180,109 | | 12/1979 | Heikkinen . | |
| 4,239,119 | | 12/1980 | Kroell . | |
| 4,295,507 | | 10/1981 | Karlsson . | |
| 4,351,485 | | 9/1982 | Hardwick et al. . | |
| 4,574,854 | | 3/1986 | Lindblom et al. . | |
| 4,582,106 | * | 4/1986 | Huhta et al. | 144/208.1 |
| 4,665,961 | | 5/1987 | Forslund . | |
| 4,685,498 | | 8/1987 | Nakajima et al. . | |
| 4,691,750 | | 9/1987 | Nakajima . | |
| 5,094,281 | | 3/1992 | Barnhill et al. . | |
| 5,394,912 | | 3/1995 | Hume . | |
| 5,699,843 | * | 12/1997 | Gagne | 144/208.9 |
| B1 4,691,750 | | 10/1996 | Nakajima . | |

FOREIGN PATENT DOCUMENTS

| | | |
|---|---|---|
| 1225309 | 8/1987 | (CA) . |
| 94804 | 2/1963 | (DK) . |
| 30-38554 | 2/1985 | (JP) . |
| 60-38553 | 2/1985 | (JP) . |
| 60-38559 | 8/1985 | (JP) . |
| 60-38568 | 8/1985 | (JP) . |
| 309818 | 9/1971 | (RU) . |
| 154817 | 5/1956 | (SE) . |

* cited by examiner

*Primary Examiner*—W. Donald Bray
(74) *Attorney, Agent, or Firm*—Alix, Yale & Ristas, LLP

(57) ABSTRACT

An apparatus for removing bark from a wood and bark containing log flow. The apparatus includes a number of bark separation units, each of the bark separation units comprising an aggregate of a toothed disc mounted on a first disc shaft and a smooth-surface disc mounted on a second disc shaft. The disc shafts are set crosswise relative to a feeding direction A applied to the log flow by the toothed disc upon the rotation thereof and at a distance from each other. The toothed disc and the substantially smooth-surface disc of a bark separation unit are set in a staggered fashion relative to each other in the axial direction of the disc shafts.

15 Claims, 3 Drawing Sheets

APPARATUS FOR REMOVING BARKS FROM A WOOD- AND BARK-CONTAINING LOG FLOW

CROSS REFERENCE TO RELATED APPLICATIONS

This is The National Stage of International Application No. PCT/FI 97/00762, filed Dec. 8, 1997.

The present invention relates to an apparatus for removing barks from a wood- and bark-containing log flow to be fed into the apparatus.

In view of the quality of pulp, it is important that the amount of barks ending up in chipping along with tree trunks be kept as small as possible. Separation the bark off the surface of tree trunks is usually carried out in a barking drum, wherein the relative motion and attrition of tree trunks result in the bark peeling off the surface of tree trunks. The loose finely crushed bark falls mostly through the bark openings of the drum onto a bark conveyor set below the drum. However, the loose bark removed in the form of long strips or large sheets strives to come out of the discharge end of the barking drum along with tree trunks. Such hard-to-bark trees include several species of hardwood, such as eucalyptus, acacia, hickory, and birch.

If the discharge end of a barking drum turns out bark entangled with logs and in the form of individual strips or bark balls (bark balls in this context refer to a heap consisting of more or less intertwined barks, possibly containing also pieces of wood, slivers or the like), the removal of most of said bark is endeavoured prior to chipping or other such treatment of the logs. Partial separation of bark can be effected by means of a purposely designed roller system. However, the bark balls and some of the long bark strips are difficult to remove by means of a roller system; a moderately close-spaced, wood (pieces of wood) saving roller system tends to leave almost the entire bark ball and some of the loose barks in the log flow, whereas a wide-spaced roller system removes most of the loose barks and even some of the bark balls but results simultaneously major losses of wood.

The Applicant's earlier patent FI 76511 discloses an apparatusas described above for removing barks. Operation of the apparatus is based on a roller system, including a spiked rollers and smooth-surface rollers, which are vertically staggered relative to each other and wherein, furthermore, a smooth roller set between two spiked upper rollers is located closer to the upstream spiked roller than to the downstream spiked roller for dropping the barks through this wider gap onto a conveyor below. The apparatus is primarily intended for the removal of short barks. The removal of material containing long barks and especially bark balls is more difficult to handle with this type of apparatus.

An object of the invention is to provide an apparatus of the above type, which is capable of removing various barks, especially long barks and bark balls from a log flow containing wood and bark.

According to the invention, this object is achieved in such a manner that and an apparatus of the invention is characterized in that the appratus includes a number of bark separation units, each of said bark separation units comprising an aggregate of a toothed disc mounted on a disc shaft and a smooth-surface disc mounted on a second disc shaft, that the disc shafts are set crosswise relative to a feeding direction A applied to the log flow by the toothed disc upon the rotation thereof and at a distance from each other, and that the toothed disc and the substantially smooth-surface disc of a bark separation unit are set in a staggered fashion relative to each other in the axial direction of the disc shafts.

In the apparatus of the invention, the toothed discs provide a log flow with a momentum in the advancing direction of a tooth and simultaneously the teeth apply to the log a vibration effect, whereby the short barks or those extending radially of the discs fall directly in between the discs and further onto a conveyor or the like below. The forward motion of barks or bits of bark advancing in a crosswise position on top of the discs decelerates at a smooth-surface disc, whereby the teeth of a toothed disc, especially if designed as take-up teeth, force the barks—possibly one bit at a time—through a gap between the smooth-surface disc and the toothed disc down onto a bark conveyor or the like.

In a preferred embodiment of the invention, the configuration is such that the disc shaft carries a number of discs spaced from each other in the axial direction of the disc shaft, said discs being selected from a group comprising toothed discs and substantially smooth-surface discs. Thus, in the apparatus of the invention, the disc shaft may carry a number of toothed discs only or a number of smooth-surface discs only or the disc shaft may be provided both with a desired number of toothed discs and a desired number of smooth-surface discs.

In one preferred embodiment of the invention, the configuration is such that the discs carried by two disc shafts successive in said feeding direction A are set overlappingly relative to each other in the radial direction of the disc shafts. The radial overlap can be varied for influencing on the efficiency of bark ramoval. The lesser the overlap, or especially if there is no overlap at all, the more certain is the removal of barks. At the same time, however, this results in increased losses of timber since wood material will also have an easier discharge passage along with barks.

In order to intensify and facilitate the removal of barks, the arrangement in one preferred embodiment of the invention is such that the smooth-surface discs are adapted to have a peripheral speed which is lower than that of the toothed discs. If necessary, the arrangement may be such that the smooth-surface discs are adapted to rotate in the opposite direction relative to the toothed discs. In order to achieve the best possible result, the arrangement may be such that the smooth-surface discs and the toothed discs have a relative peripheral speed difference which is adapted to be variable. By virtue of these measures, the advancing movement of bark can be momentarily decelerated at a smooth-surface disc, whereby the teeth of said toothed discs have more time to work for the removal of barks and for dropping the same onto a conveyor set below the discs.

In order to intensify the vibration effect produced by the toothed discs, the configuration of the invention is such that the teeth of adjacent toothed discs mounted on a common disc shaft are offset relative to each other. Thus, the teeth of a toothed disc shaft are readily capable of gripping resilient barks, yet incapable of gripping rigid pieces of wood so as to break the pieces of wood and force the removal of the same from the apparatus through a gap between the disc shafts.

In one preferred embodiment of the invention, the configuration is such that the width of the toothed discs as measured in the axial direction of the disc shaft exceeds the corresponding width of the smooth-surface discs. Among other things, this contributes to the deceleration of the advancing movement of bark at a smooth-surface disc, whereby the toothed discs are capable of taking the bark more effectively through a gap between the disc shaft carrying toothed discs and the disc shaft carrying smooth-surface discs onto a conveyor or the like set therebelow.

The log flow may be adapted to advance into the apparatus itself at an angle, which is within the range of about 0° –about 90° relative to the lengthwise direction of the disc shaft.

The invention will now be described in more detail by way of example with reference made to the accompanying drawings, wherein.

Figure 2:
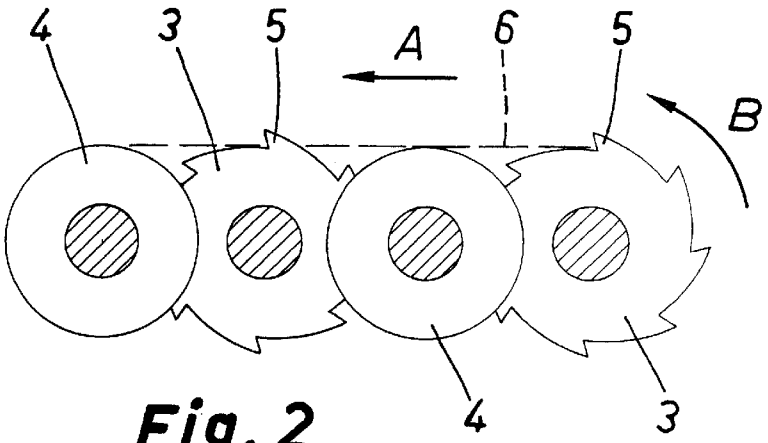
FIG. 2 shows a section along a line II—II in FIG. 1.

The apparatus shown in the drawings is intended for removing barks from a wood- and bark-containing log flow being fed into the apparatus. The apparatus can be set up e.g. as part of a roller conveyor running between a barking drum and a chipper.

The apparatus includes a number of bark separation units, each of said bark separation units comprising an aggregate of a toothed disc mounted on a disc shaft and a smooth-surface disc mounted on a second disc shaft. The disc shafts are set crosswise relative to a feeding direction A applied to the log flow by the toothed disc upon the rotation thereof and at a distance from each other. In the direction A, the first 1 of two successive disc shafts 1, 2 included in said aggregate in the embodiment depicted in the drawing is fitted in the axial direction of the disc shaft with a number of spaced-apart toothed discs 3 and the second 2 in the axial direction of the disc shaft with a number of spaced-apart substantially smooth-surface discs 4.

It should be noted, however, that one and the same shaft can be fitted with both toothed discs 3 and smooth-surface discs 4. This can be implemented for example in such a manner that one end of a disc shaft carries toothed discs 3 and the other end carries smooth-surface discs 4. According to FIG. 4, such a disc shaft can be journalled at both ends thereof and provided with elements (not shown) for rotating the shaft. If the relative peripheral speed of toothed discs 3 and smooth-surface discs 4 is desired to be variable, the disc shaft can be split up in a per se known manner and fitted with independent drive units.

Figure 1:
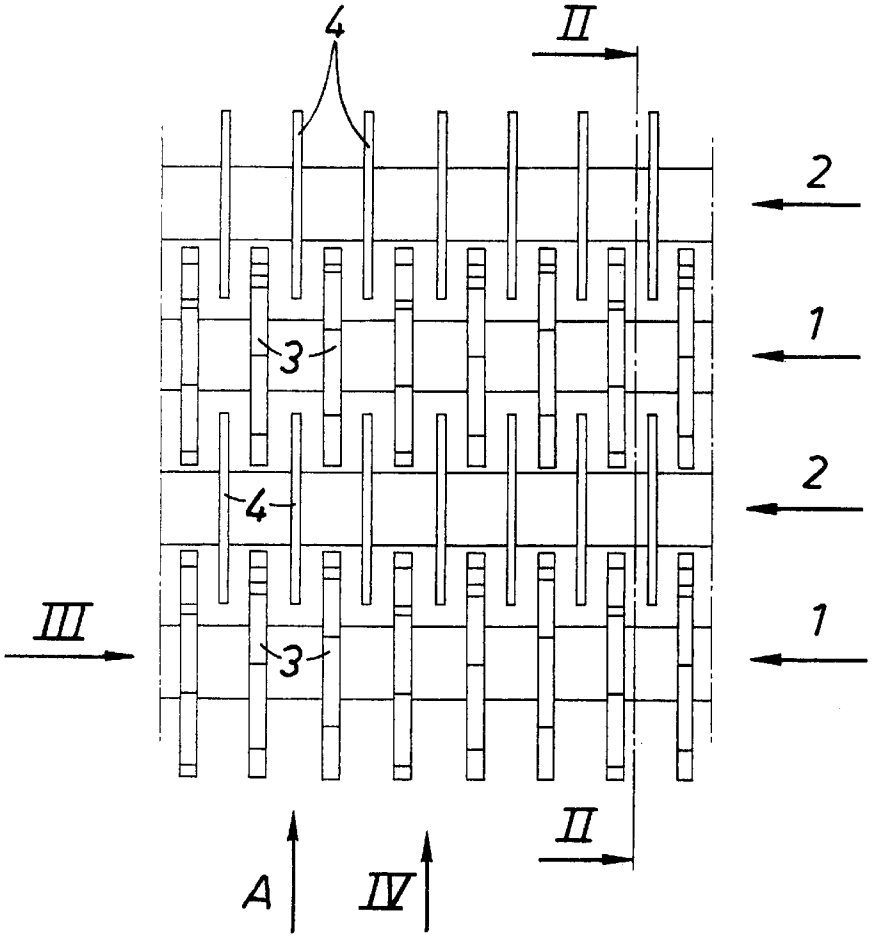
FIG. 1 is a schematic plan view of an apparatus according to one embodiment of the invention.

In the exemplary embodiment shown in FIG. 1, the apparatus includes two disc shafts 1 fitted with toothed discs 3 and two disc shafts 2 fitted with smooth-surface discs 4. In the direction of an arrow A, the first one is a disc shaft 1 fitted with toothed discs 3, alternately followed by a disc shaft 2 fitted with smooth-surface discs 4 and a disc shaft 1 fitted with toothed discs 3. The motion of a log flow in the apparatus is produced by toothed discs 3 rotatable in the direction of an arrow B.

The discs 3 carried by two successive disc shafts 1, 2 are set in the axial direction of the disc shafts 1, 2 in a staggered formation relative to each other. This makes it possible to position the discs 3, 4 of two successive disc shafts 1, 2 also in the radial direction of the disc shafts in an overlapping formation relative to each other, the relative distance between the disc shafts 1, 2 being adjustable for an optimal result.

In the solution shown in FIGS. 1–4, the toothed disc 3 is provided with circumferential teeth 5, which are adapted to extend above a covering surface 6 defined by the highest reaching surfaces of the smooth-surface discs 4, said covering surface being in this example constituted by a flat surface and, thus, the log flow is afforded its advancing motion in the direction of the arrow A primarily by means of the toothed discs 3.

Each toothed disc 3 is provided with a number of teeth 5 which, in the preferred embodiment of FIG. 2, are designed as take-up teeth. Hence, the teeth 5 of the toothed disc 3 has a negative cutting angle. In other words, the tooth 5 is shaped in such a fashion that it tends to pull along the bark located upstream thereof and pressing against the circumferential surface of the disc 3 as a result of gravity and to drop it onto a conveyor or the like (not shown) below. However, the teeth 5 are designed to have such a low height that said teeth are not the same way capable of gripping rigid and elongated pieces of wood and of dropping the same onto the conveyor.

Figure 3:
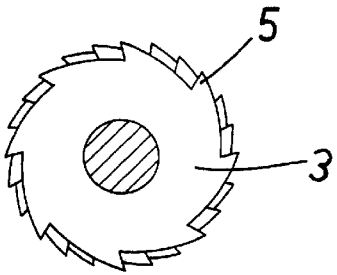
FIG. 3 is an end view of a disc shaft fitted with toothed discs in the direction of an arrow III in FIG. 1.

The teeth 5 of adjacent toothed discs 3 mounted on a common disc shaft 1 are offset relative to each other, as best depicted in FIG. 3. This contributes to the fact that the teeth 5 of a disc shaft 1 fitted with toothed discs 3 are readily capable of gripping resilient barks, yet incapable of gripping rigid pieces of wood so as to break the pieces of wood and force the same out of the apparatus onto a conveyor or the like set therebelow.

In order to make the removal of barks more effective, it is preferred that the relative peripheral speed difference between smooth-surface discs 4 and toothed discs 3 be adapted to be variable. In order to implement this, the disc shafts 1 fitted with toothed discs 3 and the disc shafts 2 fitted with smooth-surface discs 4 are provided with per se known types of drive units (not shown), controlled independently of each other.

The toothed discs 3 have a width D measured in the axial direction of the disc shaft, which preferably exceeds a corresponding width d of the smooth-surface discs. This contributes to the deceleration of the bark movement in the direction of an arrow A at the smooth-surface disc 4, whereby the toothed discs 3 will be more effective in carrying the bark through a gap between the disc shaft 1 fitted with toothed discs 3 and the disc shaft 2 fitted smooth-surface discs 4 onto a conveyor or the like (not shown) set therebelow.

Figure 4:
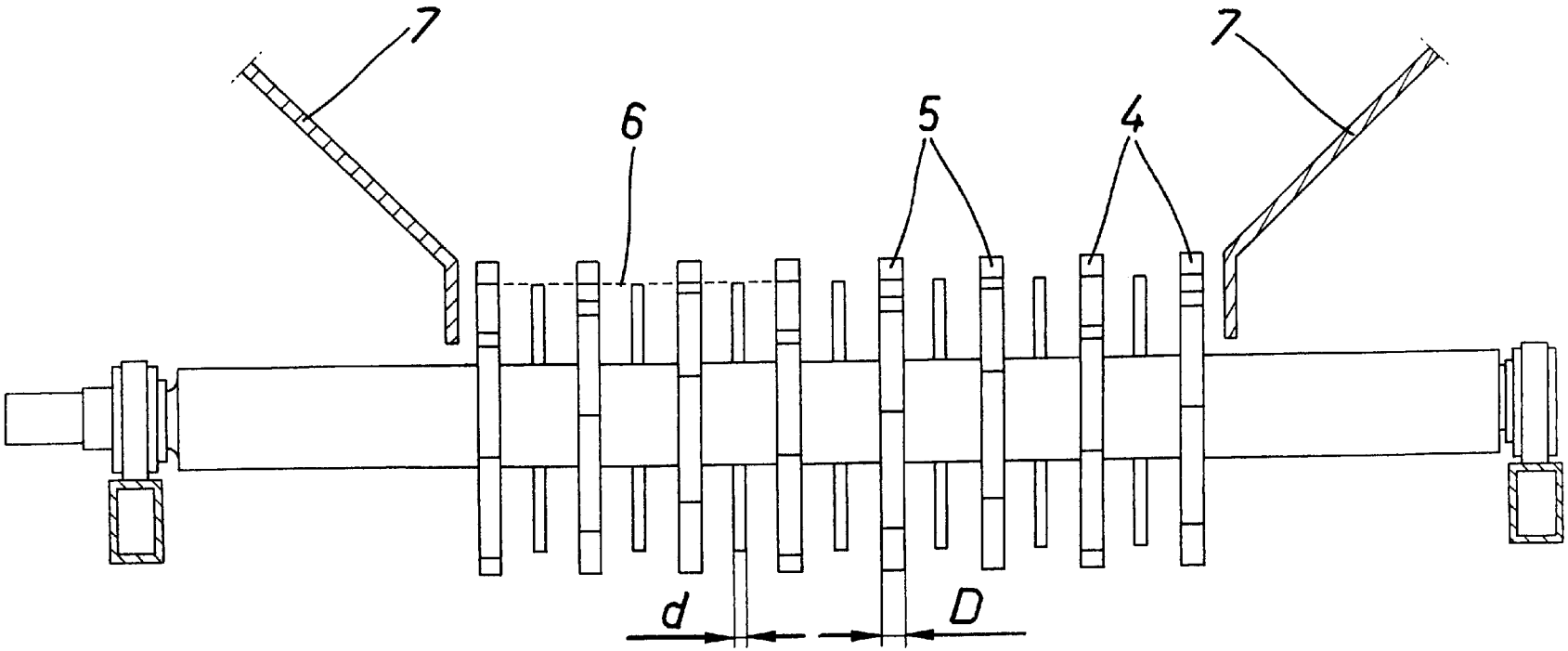
FIG. 4 is an end view of an apparatus according to one embodiment of the invention in the direction of an arrow IV in FIG. 1.

In the illustrated solution, a log flow is adapted to be supplied into the apparatus itself in a direction substantially perpendicular to the disc shafts 1, 2. Thus, the log flow travels in a trough provided wqith fixed side walls 7, the floor of said trough being constituted by an apparatus of the invention (FIG. 4).

It should be appreciated, however, that the apparatus of the invention can also be applied in such a solution, wherein a log flow is adapted to be fed into the apparatus itself in a direction substantially parallel to the disc shafts 1, 2 or even at an oblique angle relative to the disc shafts 1, 2. In this case, the disc shafts 1, 2 are positioned relative to each other so as to constitute a trough having e.g. a U-shaped cross-section (FIG. 5), said trough being set in an inclined position to afford the log flow also with a motion in the direction of the longitudinal axis of the trough and, thus, also in the direction of the disc shafts 1, 2.

In this solution, the covering surface 6 grazing the smooth-surface discs 4 from the inside is trough-shaped instead of being a flat surface, as in the solution of FIG. 2.

The log flow is provided with a momentum parallel to the arrow A, i.e. transverse to the disc shafts 1, 2, by means of the teeth 5 of toothed discs 3 as a result of a rotating motion B of the discs 3. Thus, the teeth 5 of toothed discs 3 need not, and preferably should not extend inside the trough-shaped covering surface 6 grazing the smooth-surface discs 4 from the inside.

Figure 5:
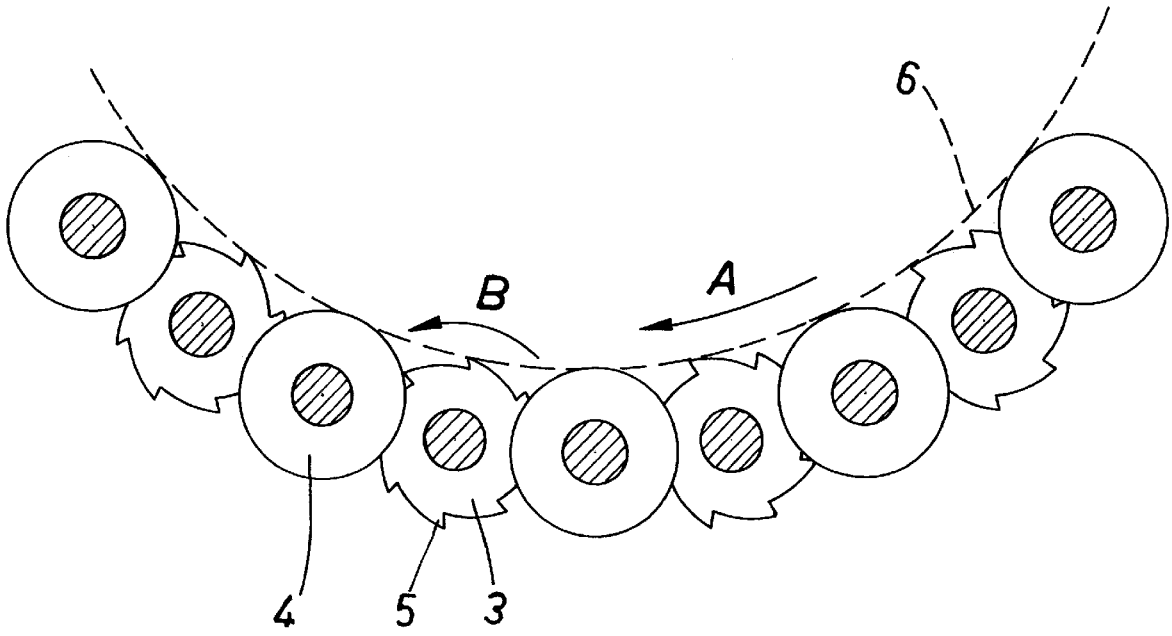
FIG. 5 shows a section similar to FIG. 2 of an apparatus according to a second embodiment of the invention.

As a result of the rotating motion B of the discs 3, the log flow urges in the solution of FIG. 5 towards the left-hand trough section and simultaneously, as a result of the inclination of the lengthwise axis of the trough, the log flow is subjected to a motion parallel to the disc shafts 1, 2.

What is claimed is:

1. An apparatus for removing bark from a log flow to be fed into the apparatus, wherein the apparatus includes a number of bark separation units, each of said bark separation units comprising an aggregate of a toothed disc mounted for rotation on a first disc shaft and a smooth-surface disc mounted for rotation on a second disc shaft, the disc shafts are set crosswise relative to a feeding direction A applied to the log flow by the toothed disc upon a rotation thereof and at a distance from each other, and the toothed disc and the substantially smooth-surface disc of a bark separation unit are set in a staggered fashion relative to each other in an axial direction of the disc shafts.

2. An apparatus as set forth in claim 1, wherein each said disc shaft carries a plurality of discs set at a distance from each other in the axial direction of the disc shaft, said plurality of discs comprising toothed discs, substantially smooth-surface discs or a combination thereof.

3. An apparatus as set forth in claim 1, wherein the discs mounted on two adjacent disc shafts are set in an overlapping formation relative to each other in a radial direction of the disc shafts.

4. An apparatus as set forth in claim 1 wherein the toothed disc includes a take-up tooth.

5. An apparatus as set forth in claim 2, wherein the teeth of adjacent toothed discs mounted on a common disc shaft are radially offset relative to each other.

6. An apparatus as set forth in claim 1, wherein the smooth-surface discs are adapted to have a peripheral speed which is lower than a peripheral speed of the toothed discs.

7. An apparatus as set forth in claim 6, wherein the smooth-surface discs are adapted to rotate in an opposite direction relative to the toothed discs.

8. An apparatus as set forth in claim 6, wherein the relative difference in peripheral speeds between the smooth-surface discs and the toothed discs is adapted to be variable.

9. An apparatus as set forth in claim 1, wherein a width D measured for the toothed discs in the axial direction of the disc shaft exceeds a corresponding width d of the smooth-surface discs.

10. An apparatus as set forth in claim 1, wherein the log flow is adapted to be fed into the apparatus at an angle between about 0° and about 90° relative to the axial direction of the disc shaft.

11. An apparatus for removing bark from a log, comprising:

means for moving said log in a feeding direction; and a plurality of bark separation units, each said bark separation unit including;

a rotatable first shaft;

a toothed disk mounted to said first shaft at a first axial position;

a rotatable second shaft spaced from said first shaft; and a smooth-surface disk mounted to said second shaft at a second axial position offset in relation to said first axial position.

12. The apparatus of claim 11, wherein each said shaft includes a plurality of disks mounted thereto, each said disk selected from the group consisting of toothed disks smooth surface disks and combinations thereof.

13. The apparatus of claim 12, wherein the plurality of disks mounted on said first shaft are each axially staggered with relation to the plurality of disks mounted on said second shaft.

14. The apparatus of claim 12, wherein said shafts are perpendicular to said feeding direction and said disks are parallel to said feeding direction.

15. The apparatus of claim 14, wherein:

each said first shaft of a said bark separation unit precedes each said second shaft in the feeding direction; and said plurality of disks on said second shaft of a leading bark separation unit are axially offset with respect to said plurality of disks on said first shaft of a following bark separation unit.

* * * * *